US006937200B2

(12) United States Patent
Takei

(10) Patent No.: US 6,937,200 B2
(45) Date of Patent: Aug. 30, 2005

(54) ANTENNA AND WIRELESS APPARATUS

(75) Inventor: Ken Takei, Kawasaki (JP)

(73) Assignees: Hitachi, Ltd., Tokyo (JP); Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 10/781,676

(22) Filed: Feb. 20, 2004

(65) Prior Publication Data

US 2005/0012674 A1 Jan. 20, 2005

(30) Foreign Application Priority Data

Jul. 17, 2003 (JP) ..... 2003-198217

(51) Int. Cl.[7] ..... H01Q 13/10
(52) U.S. Cl. ..... 343/767; 343/702
(58) Field of Search ..... 343/700 MS, 702, 343/767, 770

(56) References Cited

U.S. PATENT DOCUMENTS 4,197,545 A * 4/1980 Favaloro et al. ..... 343/700 MS
5,317,324 A * 5/1994 Naito et al. ..... 343/700 MS
6,392,609 B2 * 5/2002 Nieminen ..... 343/767
6,509,879 B2 * 1/2003 Cassel ..... 343/767
6,765,538 B2 * 7/2004 Fang ..... 343/770
6,806,839 B2 * 10/2004 Lo ..... 343/725

FOREIGN PATENT DOCUMENTS

JP 61-265905 11/1986 ..... H01Q/5/00
JP 1-158805 6/1989 ..... H01Q/9/30

* cited by examiner

*Primary Examiner*—Tan Ho
(74) *Attorney, Agent, or Firm*—Antonelli, Terry, Stout & Kraus, LLP

(57) ABSTRACT

The present invention provides an antenna in which a single exciting point can be commonly used by a plurality of frequencies, particularly, a small multi-mode plate antenna, and a small and cheap multi-media wireless apparatus using the antenna. In the antenna, a slit 2 is formed in a conductive plate 1, and resonance is made at an exciting point 3 provided in a part of the conductive plate around the slit 2. Further, enclosed openings 4, 6 are formed in parts which are capacitive when seen from the exciting point 3 on the conductive plate 1, and inductances are formed by conductive strips 5, 7 in the enclosed openings 4, 6 respectively. Another resonance is generated by the conductive strips 5, 7. In such a manner, resonances corresponding to a plurality of frequencies are realized at the exciting point 3.

11 Claims, 10 Drawing Sheets

ANTENNA AND WIRELESS APPARATUS

FIELD OF THE INVENTION

The present invention relates to a wireless apparatus for providing various services to the user and an antenna mounted on the apparatus and, more particularly, to a multimedia wireless apparatus for providing a plurality of services by information transfer using electromagnetic waves of different frequencies as medium, and a multi-mode antenna mounted on the apparatus.

BACKGROUND OF THE INVENTION

In recent years, multimedia services which provide services regarding information transmissions and information provision by radio are becoming active, and a number of wireless apparatuses have been developed and put into commercial use. The services are being diversified to the telephone, television, LAN (Local Area Network) and the like year after year. To enjoy all of the services, the user has to have wireless apparatuses corresponding to the individual services.

To improve the convenience for the user to enjoy such services, movement of providing the multimedia services any time, any where without making the user aware of the existence of the media, that is, in a ubiquitous manner has started, and a so-called multi-mode apparatus realizing a plurality of information transmission services by itself is realized.

Since normal wireless ubiquitous information transmission uses electromagnetic waves as a medium, in the same service area, by using one frequency for one kind of service, a plurality of services are provided to the users. Therefore, the multimedia apparatus has the function of transmitting/receiving electromagnetic waves of a plurality of frequencies.

A conventional multimedia apparatus employs, for example, a method of preparing a plurality of antennas each of a single mode corresponding to one frequency and mounting the antennas on a single wireless apparatus. According to the method, the single-mode antennas have to be mounted apart from each other by a distance of about a wavelength so as to operate independently. Since frequencies of electromagnetic waves used for services regarding normal ubiquitous information transmission are limited to a few hundreds MHz to a few GHz due to regulation of propagation characteristics in a free space, the distance between neighboring antennas is tens cm to a few meters. Therefore, the dimensions of the apparatus become large, and portability for the user is not satisfied. Since antennas having sensitivities to different frequencies are disposed with sufficient distance, there is the problem of increase in dimensions of the apparatus.

There is another antenna having sensitivities to a plurality of frequency bands. For example, a two-frequency antenna in which one end of a loop antenna or an aerial member is coupled to an RF circuit handling one frequency and the other end is coupled to an RF circuit handling a different frequency is disclosed in Japanese Patent Laid-Open Nos. S61(1986)-265905 and H1(1989)-158805.

In the two-frequency antenna disclosed in Japanese Patent Laid-Open No. S61(1986)-265905, a first resonant circuit is connected to one of terminals of a loop antenna as a radiator and a second resonant circuit is connected to the other terminal. A configuration is employed such that the one terminal resonates at a transmitting frequency and the other terminal resonates at a receiving frequency, a transmitting circuit is connected to the one terminal (transmitting output terminal), and a receiving circuit is connected to the other terminal (receiving input terminal).

On the other hand, the two-frequency antenna disclosed in Japanese Patent Laid-Open No. H1-158805 employs a configuration such that a first resonant circuit which resonates at a transmitting frequency and is connected between one of terminals of an aerial member as a radiator and a transmitting output terminal has a high impedance to a receiving frequency, and the aerial member is disconnected from the transmission output terminal. A second resonant circuit which resonates at a receiving frequency and is connected between the other terminal of the aerial member and a receiving input terminal has a high impedance to the transmitting frequency, and the aerial member is disconnected from the receiving input terminal.

SUMMARY OF THE INVENTION

Also in the case of using the two-frequency antenna in a wireless apparatus using two frequencies, input and output terminals (exciting points) handling different frequencies are positioned apart from each other, so that RF circuits have to be prepared to the input and output terminals in positions apart from each other. Consequently, it is difficult to integrate the RF circuits and miniaturization of the wireless apparatus is disturbed.

This situation becomes more serious in the case where the wireless apparatus is requested to have sensitivities to a larger number of frequency bands. For a multi-mode apparatus of, for example, three or four modes, each of the conventional antennas requires a plurality of RF circuits and miniaturization of the wireless apparatus is largely disturbed. Even in a single RF circuit constructed so as to be able to handle a plurality of frequencies, in addition to a plurality of input and output terminals for RF signals, a frequency divider and a multiplexer are required. Further, a plurality of RF cables are necessary to the antenna. It largely disturbs miniaturization of a multimode wireless apparatus and cost reduction of the product.

A resonant circuit is usually realized by a capacitor and an inductor as electric circuit elements. In a conventional antenna using such a resonant circuit, to make the resonant circuit operate independently of the radiator of the antenna, ground level of the electric circuit element having no relation with the operation of the radiator has to be assured, so that the structure of the antenna includes a plurality of conduction systems. To be concrete, the antenna structure becomes a multi-layered structure or a structure in which an RF circuit board for generating a signal to be supplied to the antenna and some conductors provided near the board are integrated. Both of the structures disturb miniaturization of the antenna and reduction in manufacturing cost of the antenna.

From the above, in the antenna used for a multi-media wireless apparatus, particularly, a multi-mode antenna, if a single exciting point (input/output terminal) can be used for electromagnetic waves of different frequencies, RF circuits handling a plurality of frequencies can commonly use one exciting point, so that a semiconductor integrated circuit technology can be applied. Therefore, miniaturization of an RF circuit part for a plurality of frequencies can be realized, and a small, cheap multi-media wireless apparatus can be realized.

A multi-mode antenna is an antenna having sensitivities to electromagnetic waves of a plurality of frequencies, and is defined as an antenna realizing a matching characteristic between a characteristic impedance of a free space and a characteristic impedance of an RF circuit of the wireless apparatus with respect to electromagnetic waves of a plurality of frequencies by a single structure.

An object of the present invention is to provide an antenna capable of sharing one exciting point for a plurality of frequencies, particularly, a small multi-mode plate antenna, and a small, cheap multi-media wireless apparatus.

To achieve the object, an antenna of the present invention is characterized in that a slit is formed in a conductive plate, an enclosed opening which is surrounded by the conductor is formed in the conductive plate, a conductive strip connecting two different points in the surrounding conductor is formed in the enclosed opening, and a part of the conductive plate is used as an exciting point. In particular, when the antenna is a multi-mode antenna, the present invention produces a larger effect. The present invention has been achieved on the basis of the following new knowledge found by the inventors herein.

In the case of constructing the antenna by a conductive plate, if a dimension of the conductive plate such as length or width is about odd-number times of a half-wavelength corresponding to a specific frequency, it is unnecessary to deform the conductive plate. However, generally, an antenna to be applied to the wireless apparatus, particularly, a portable wireless apparatus is requested for large reduction in the dimension with respect to the wavelength used in a wireless system providing services to the wireless apparatus. The antenna having such dimensions is too large to be used.

Reduction in the dimensions can be realized by using a resonance phenomenon at a specific frequency. To realize the reduction in size, the conductive plate has to be deformed by forming any pattern such as a slit, a slot or the like in the conductive plate.

In the case where a resonance phenomenon occurs in the conductive plate when a part of the conductive plate is set as an exciting point irrespective of the deformation, it means that current density induced on the conductive plate is constructed by a part having a faster phase and a part having a delayed phase when seen from the exciting point.

The part in which current density having the faster phase exists is inductive when seen from the exciting point, and the part in which current density having the delayed phase exists is capacitive when seen from the exciting point. Therefore, by mounting an electric circuit element having a lumped or distributed parameter of capacitance in the part having the faster phase and mounting an electric circuit element having a lumped or distributed parameter of inductance in the part having the delayed phase, a new resonance phenomenon seen from the exciting point can be realized.

When the conductive plate is deformed as necessary and a point of the conductive plate is used as an exciting point, by forming an electric circuit element having a lumped or distributed parameter in the part which is inductive or capacitive when seen from the exciting point, a new resonance phenomenon can be brought about in the conductive plate.

The situation can be also understood by assuming a state in which the conductive plate is divided into "n" segments. On each of the "n" divided conductor segments, induced current is generated. Assuming now that the exciting point is provided on the first segment, the following matrix equation (1) is obtained by (n) induced currents I1, I2, . . . , and In.

$$\begin{pmatrix} a11 & \cdots & a1i & \cdots & a1n \\ \vdots & & \vdots & & \vdots \\ ai1 & \cdots & aii & \cdots & ain \\ \vdots & & \vdots & & \vdots \\ an1 & \cdots & ani & \cdots & ann \end{pmatrix} \begin{pmatrix} I1 \\ \vdots \\ Ii \\ \vdots \\ In \end{pmatrix} = \begin{pmatrix} V \\ 0 \\ \vdots \\ \vdots \\ 0 \end{pmatrix} \tag{1}$$

The matrix of the matrix equation is an impedance matrix. Each of elements a11, a12, . . . , and ann of the impedance matrix has the unit of impedance. The equation (1) can be also expressed as equation (2) by inverse matrix expression.

$$\begin{pmatrix} I1 \\ \vdots \\ Ii \\ \vdots \\ In \end{pmatrix} = \begin{pmatrix} b11 & \cdots & b1i & \cdots & b1n \\ \vdots & & \vdots & & \vdots \\ bi1 & \cdots & bii & \cdots & bin \\ \vdots & & \vdots & & \vdots \\ bn1 & \cdots & bni & \cdots & bnn \end{pmatrix} \begin{pmatrix} V \\ 0 \\ \vdots \\ \vdots \\ 0 \end{pmatrix} \tag{2}$$

The matrix of the matrix equation (2) is an admittance matrix, and each of elements b11, b12, . . . , and bnn of the matrix has a unit of admittance.

Since the input admittance of the exciting point is equal to I1/V as shown in the equation (3), $$\mathbf{I1}=b11\ V$$

$$I1/V=b11 \tag{3}$$

if the antenna resonates at a frequency "f", the element b11 also displays the resonance characteristic at the frequency "f". If an inductance is mounted in the position of the i-th segment ($1 \leqq i \leqq n$), voltage generated in the position of the i-th segment is expressed by $j\omega Li$ by using an inductance value L and an angular frequency $\omega=2\pi f$. Consequently, the matrix equation in this case is expressed by the following equation (4).

$$\begin{pmatrix} I1 \\ \vdots \\ Ii \\ \vdots \\ In \end{pmatrix} = \begin{pmatrix} b11 & \cdots & b1i & \cdots & b1n \\ \vdots & & \vdots & & \vdots \\ bi1 & \cdots & bii & \cdots & bin \\ \vdots & & \vdots & & \vdots \\ bn1 & \cdots & bni & \cdots & bnn \end{pmatrix} \begin{pmatrix} V \\ 0 \\ j\omega L\ Ii \\ 0 \\ 0 \end{pmatrix} \tag{4}$$

The input admittance in the case of equation (4) is expressed by the following equation (5).

$$I1=b11\ V+b1i\ j\omega L\ Ii,\ Ii=bi1\ V+bii\ j\omega L\ Ii$$

$$I1/V = b11 - \frac{b1i\ bi1}{bii - \frac{1}{j\omega L}} \tag{5}$$

In addition to the resonance by b11 at the frequency "f", resonance can be made by the inductance L and the admittance matrix element bii. Since bii has the unit of admittance, considering that the admittance of the inductance L is the inverse of $j\omega L$, the series resonance of the capacitor and the inductor can be realized according to the sign of bii.

A necessary condition for this purpose is that the sign of the imaginary part of bii is negative. The reactance component of the i-th segment is accordingly capacitive. Since a part of structure by which an antenna is realized is equivalent to be capacitive and another part is equivalent to be inductive when the antenna occurs resonant phenomena, it is sufficient to choose a capacitive part, that is, a capacitive segment from the parts as the i-th segment.

In order to realize the multi-mode antenna by the conductive plate structure, it is sufficient to form a plurality of inductive parts and a plurality of capacitive parts on the conductive plate by properly deforming the conductive plate as necessary and load electric circuit elements to the parts.

A resonance at a first frequency when a part of a conductive plate is set as an exciting point by being deformed can be realized only by the deformation. A resonance at another frequency can be also realized by loading an electric circuit element to an inductive or capacitive part on the conductive plate having low correlation with the resonance at the first frequency.

In this case, it is sufficient to determine whether the inductive or capacitive part on the conductive plate contributes to the resonance at the first frequency from a quantitative induction value or capacitive value.

A concrete method of realizing the above-mentioned electric circuit element into the conductive plate is as follows. A portion of the conductive plate is deleted in a dimension (for example, less than 1/100) sufficiently smaller than the wavelength at which the antenna is to be operated so that the plate is surrounded by the conductor. And, in the case of an inductive circuit element, it is sufficient to form a sufficiently narrow linear or bent line having a narrow pattern width realizing an impedance (for example, hundreds ohms when the nominal impedance is 50 ohms) sufficiently higher than the nominal impedance (usually, 50 ohms) of an RF circuit in the deleted portion. In the case of a capacitive circuit element, it is sufficient to form a linear or bent line having a gap of necessary width and length.

As described above, the antenna of the present invention uses the conductive plate and a circuit element is formed by deleting a part of the conductive plate, so that the antenna can be miniaturized, and the manufacturing cost can be largely reduced. Since one exciting point is shared by a plurality of frequencies, integration of an RF circuit to be connected to the antenna is easy. Particularly, in the case of applying the antenna to a multi-mode wireless apparatus, the size and manufacturing cost of the apparatus can be reduced.

These and other objects and many of the attendant advantages of the invention will be readily appreciated as the same becomes better understood by reference to the following detailed description when considered in connection with the accompanying drawings.

BRIEF DESCRIPITON OF THE DRAWINGS

DETAILED DESCRIPTION OF THE PREFERRED EMBODIMENTS

Figure 1:
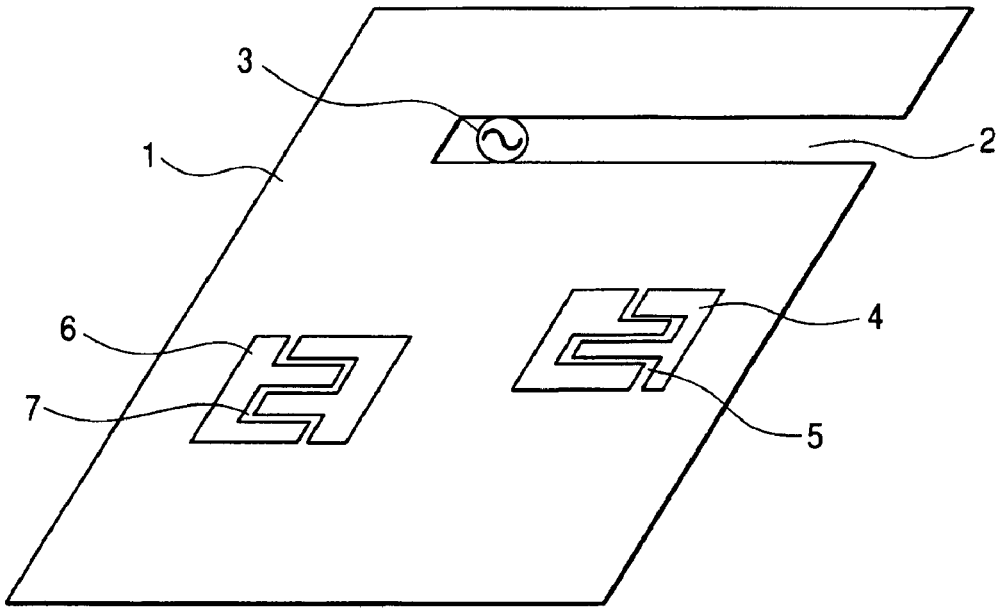
FIG. 1 is a structural drawing for explaining a first embodiment of the invention of an antenna according to the invention.

An antenna and a wireless apparatus using the antenna according to the present invention will be described hereinbelow in more details with reference to some embodiments of the invention shown in the drawings. Although the invention will be described by using an example in which a multi-mode plate antenna is employed as the antenna in the following embodiments, obviously, the antenna of the invention is not limited to the multi-mode plate antenna.

A first embodiment of the invention will be described with reference to FIG. 1. FIG. 1 is a diagram showing the configuration of a multi-mode plate antenna according to the present invention. A slit 2 is formed in a part of a conductive plate 1, and an exciting point 3 is formed in the slit 2 by using a part of the slit as an exciting level and using another part as a ground level. In the conductive plate 1, a first enclosed opening 4 and a second enclosed opening 6 which are separated from the slit 2 and surrounded by the conductor are formed, and a first conductive strip 5 and a second conductive strip 7 each connecting two different points of the conductor surrounding the enclosed openings are formed in the conductive opening.

In the embodiment, in the conductive plate 1, a resonance phenomenon occurs at a frequency "f" by the slit 2. In parts which are capacitive around the frequency "f", the enclosed openings 4 and 6 enclosing the conductive strips 5 and 7 respectively are formed.

Therefore, when each of the conductive strips 5 and 7 has a width which is narrow to a degree that a characteristic impedance sufficiently higher than an output impedance (usually 50 ohms) of an RF circuit to be coupled to the exciting point 3 is obtained, each of them operates as an inductance. Consequently, according to the inductance and a capacitive property of the place of the inductance, new resonance occurs around the frequency "f". It produces an effect of realizing a multi-mode antenna which resonates at a plurality of frequencies around the frequency "f". The line width of the conductive strips 5 and 7 is set to, for example, ¼ of the width of the slit 2 or less.

The number of resonances of the antenna according to the embodiment can be two at the maximum except for the resonance realized by the slit 2. To enlarge a matching bandwidth of the antenna at the resonance frequency, it is also possible to make the antenna resonate only at one frequency.

Although the shape of each of the enclosed openings 4 and 6 is a square in the embodiment, it may be circular, further, a closed arbitrary polygonal, or a closed curve. In the embodiment, each of the conductor strips 5 and 7 has a meander shape or folded shape. Also by a straight shape or curved meander shape, an equivalent effect can be obtained.

As described above, in the antenna of the embodiment, the conductive plate is used and a circuit element is formed by partially deleting the conductive plate. Consequently, the antenna can be miniaturized and the manufacturing cost can be largely reduced. Since one exciting point is shared by a plurality of frequencies, integration of an RF circuit part to be connected to the antenna is facilitated and miniaturization of the multi-mode wireless apparatus and reduction in manufacturing cost can be achieved.

Figure 2:
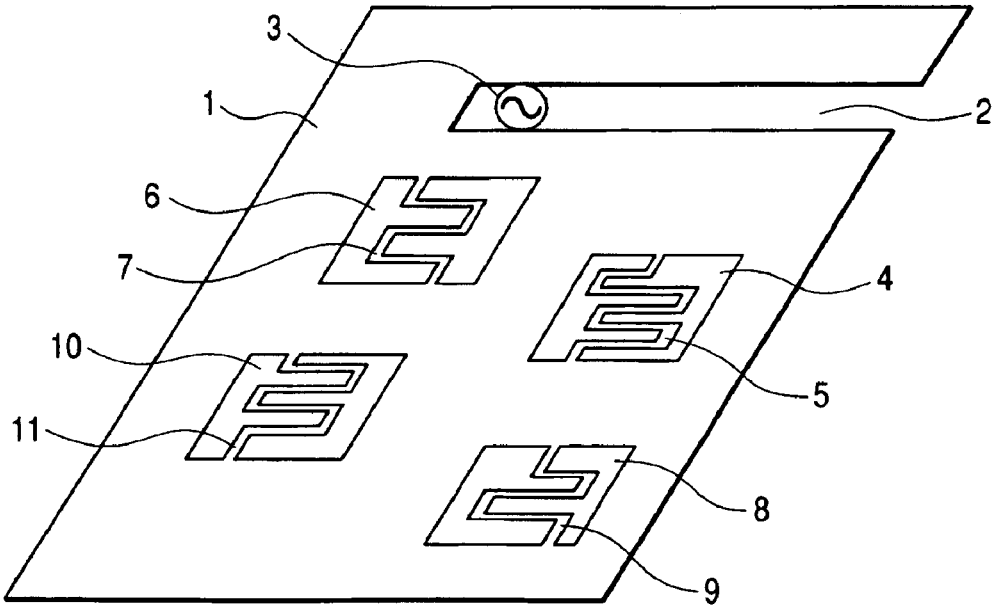
FIG. 2 is a structural drawing for explaining a second embodiment of the invention.

A second embodiment of the invention will be described with reference to FIG. 2. FIG. 2 is a diagram showing the configuration of a multi-mode plate antenna according to the present invention. The point different from the embodiment shown in FIG. 1 is that a third enclosed opening 8 and a fourth enclosed opening 10 isolated from the slit 2 and surrounded by the conductor are formed in the conductive plate 1, and a third conductive strip 9 and a fourth conductive strip 11 each connecting two different points of the conductor surrounding the enclosed opening are further formed in the enclosed openings.

According to the embodiment, the number of resonances of the antenna is four at the maximum except for resonance realized by the slit 2. As compared with the first embodiment, the multi-mode antenna produces an effect of an increased number of modes or an enlarged matching bandwidth around the resonance frequency of the antenna as compared with the embodiment of FIG. 1.

Figure 3:
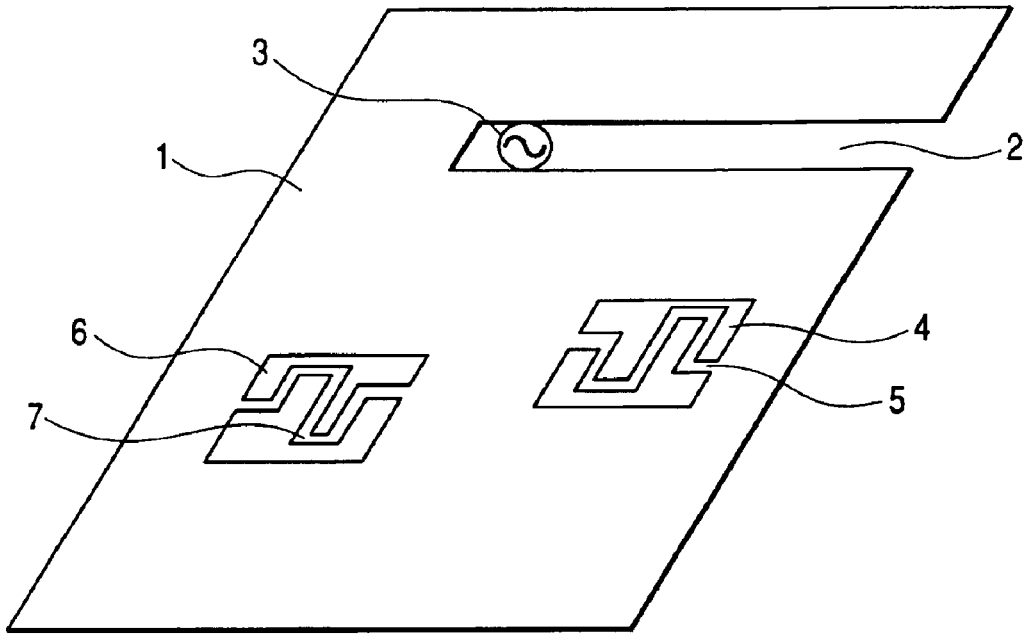
FIG. 3 is a structural drawing for explaining a third embodiment of the invention.

A third embodiment of the present invention will be described with reference to FIG. 3. FIG. 3 is a diagram showing the configuration of a multi-mode plate antenna according to the present invention. The point different from the embodiment shown in FIG. 1 is that the extending direction of each of the conductive strips 5 and 7 is almost the same as the longitudinal direction of the slit 2.

In the specification, in a conductive strip connecting two different points of the conductor surrounding an enclosed opening, a direction extending from one of two different points to the other point, that is, a direction from the start point of the conductive strip to the end point will be called an extending direction. In the first embodiment, therefore, it can be said that the extending direction of the conductive strips 5 and 7 is a direction almost orthogonal to the longitudinal direction of the slit 2.

According to the embodiment, the direction of current flowing concentratedly on the conductive strips 5 and 7 does not match the direction of current contributing to radiation generated by the slit 2. Consequently, an effect is produced that disturbance for directivity of a main polarization of the antenna which is caused by mounting of the conductive strips 5 and 7 on conductive plates is suppressed as compared with the embodiment shown in FIG. 1.

Figure 4:
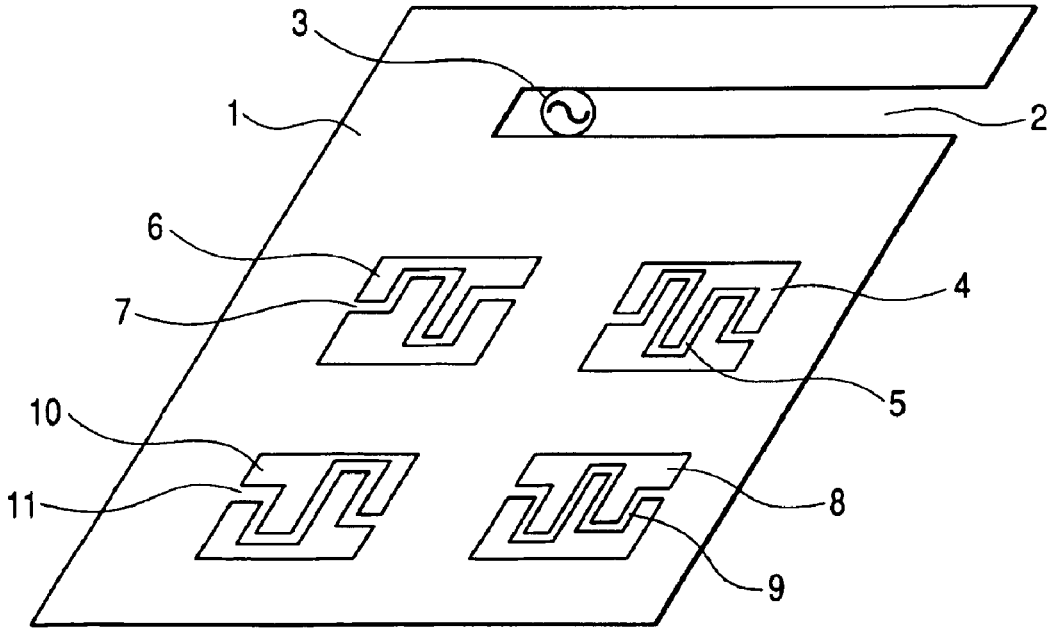
FIG. 4 is a structural drawing for explaining a fourth embodiment of the invention.

A fourth embodiment of the invention will be described with reference to FIG. 4. FIG. 4 is a diagram showing the configuration of a multi-mode plate antenna according to the present invention. The point different from the embodiment shown in FIG. 2 is that while the extending direction of the conductive strips 5, 7, 9, and 11 is almost orthogonal to the longitudinal direction of the slit 2 in the second embodiment, the extending direction of the conductive strips 5, 7, 9, and 11 is a direction almost the same as the longitudinal direction of the slit 2.

According to the fourth embodiment, the direction of current flowing concentratedly on the conductive strips 5, 7, 9, and 11 does not match the direction of current which contributes to radiation generated by the slit 2. Consequently, an effect is produced that disturbance for directivity of a main polarization of the antenna which is caused by mounting of the conductive strips 5, 7, 9, and 11 on conductive plates is suppressed as compared with the embodiment shown in FIG. 2.

Figure 5:
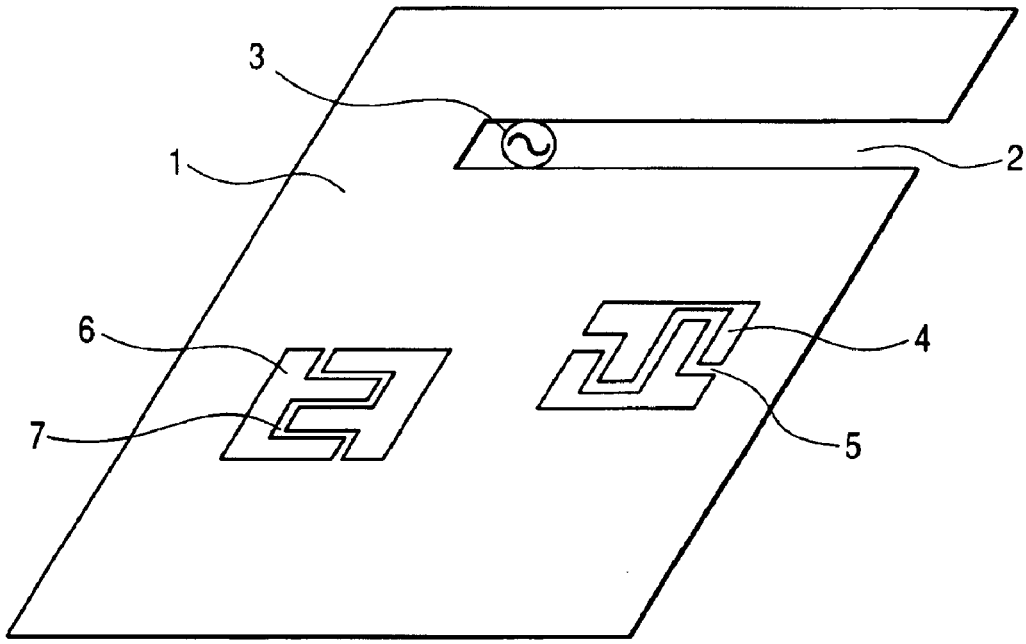
FIG. 5 is a structural drawing for explaining a fifth embodiment of the invention.

A fifth embodiment of the invention will be described with reference to FIG. 5. FIG. 5 is a diagram showing the configuration of a multi-mode plate antenna according to the present invention, which is different from the embodiment shown in FIG. 1 with respect to the point that the extending directions of the conductive strips 5 and 7 are orthogonal to each other.

According to the embodiment, the directions of currents flowing concentratedly on the conductive strips 5 and 7 are orthogonal to each other, so that directions of magnetic fields generated by the conductive strips 5 and 7 are also orthogonal to each other and interference is reduced. Therefore, also in the case where the positions of the enclosed openings 4 and 6 which are capacitive are close to each other, the operations of the inductors can be performed independently of each other. There is an effect of suppressing degeneration of a resonance phenomenon caused by interference of the magnetic fields of the inductors, in other words, dissipation of the multi-mode.

Figure 6:
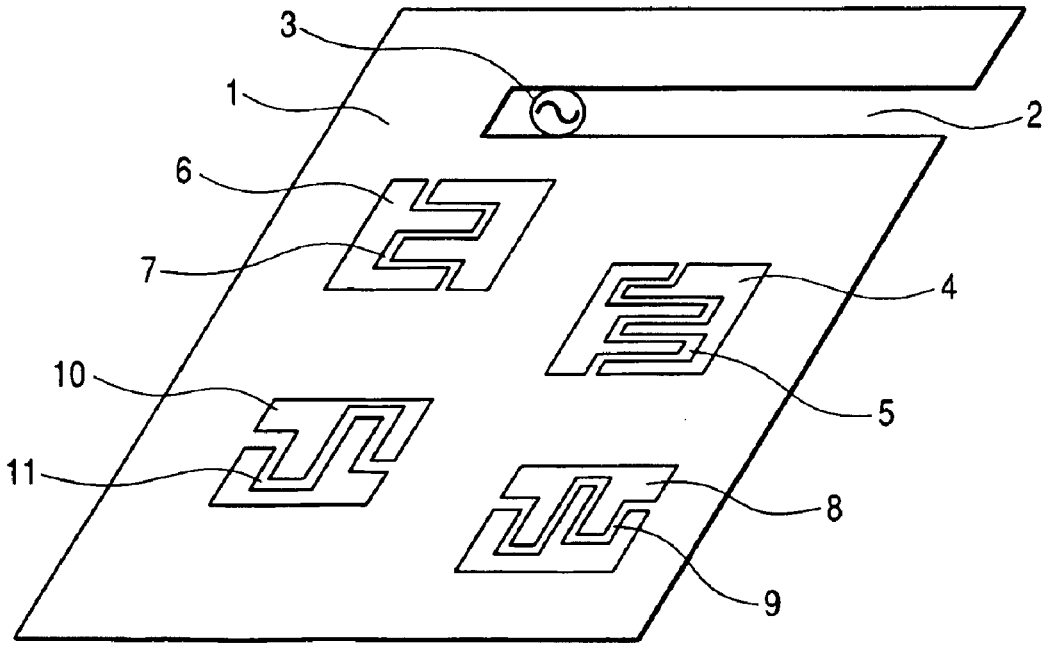
FIG. 6 is a structural drawing for explaining a sixth embodiment of the invention.

A sixth embodiment of the invention will be described with reference to FIG. 6. FIG. 6 is a diagram showing the configuration of a multi-mode plate antenna according to the present invention. The point different from the embodiment of FIG. 2 is that the extending direction of the conductive strips 5 and 7 is orthogonal to the extending direction of the conductive strips 9 and 11.

According to the sixth embodiment, the direction of currents flowing concentratedly on the conductive strips 5 and 7 and the direction of currents flowing concentratedly on the conductive strips 9 and 11 are orthogonal to each other, so that the effects similar to those of the embodiment of FIG. 5 related to the embodiment of FIG. 1 can be given to the embodiment of FIG. 2.

Figure 7:
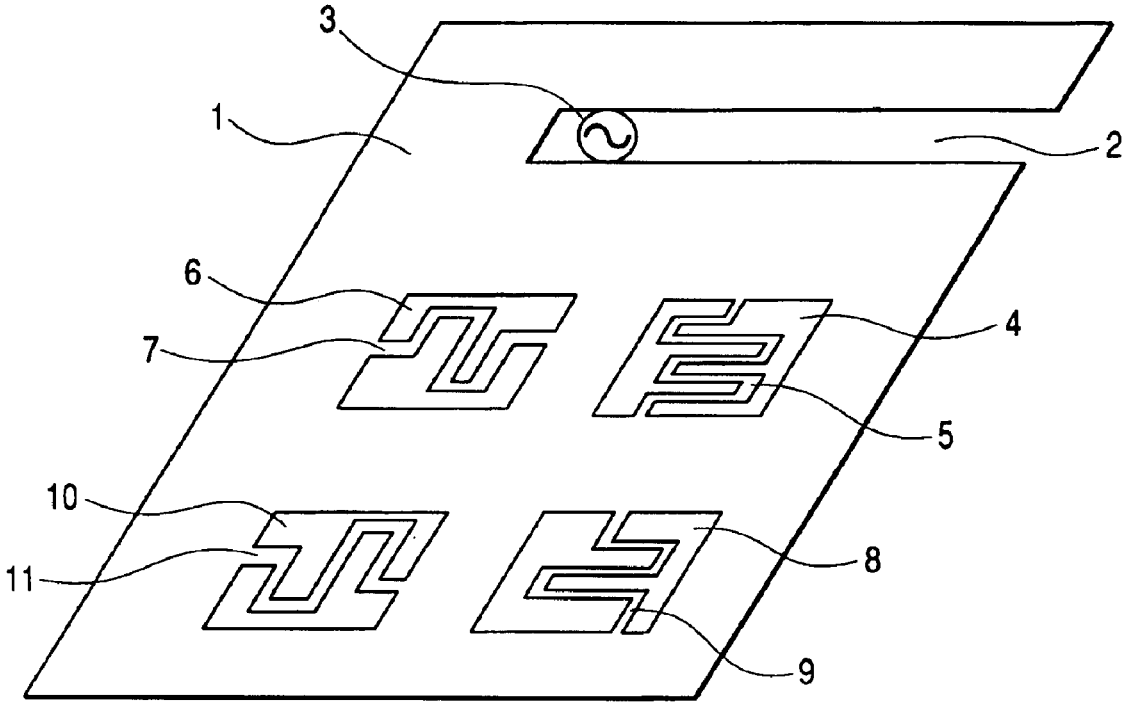
FIG. 7 is a structural drawing for explaining a seventh embodiment of the invention.

A seventh embodiment of the invention will be described with reference to FIG. 7. FIG. 7 is a diagram showing the configuration of a multi-mode plate antenna according to the invention. The point different from the embodiment of FIG. 2 is that the extending direction of the conductive strips 5 and 9 is orthogonal to that of the conductive strips 7 and 11.

According to the seventh embodiment, the direction of currents flowing concentratedly on the conductive strips 5 and 9 and that of currents flowing concentratedly on the conductive strips 7 and 11 are orthogonal to each other. Thus, effects similar to those of the sixth embodiment related to the embodiment of FIG. 2 can be given to the embodiment of FIG. 2.

Figure 8:
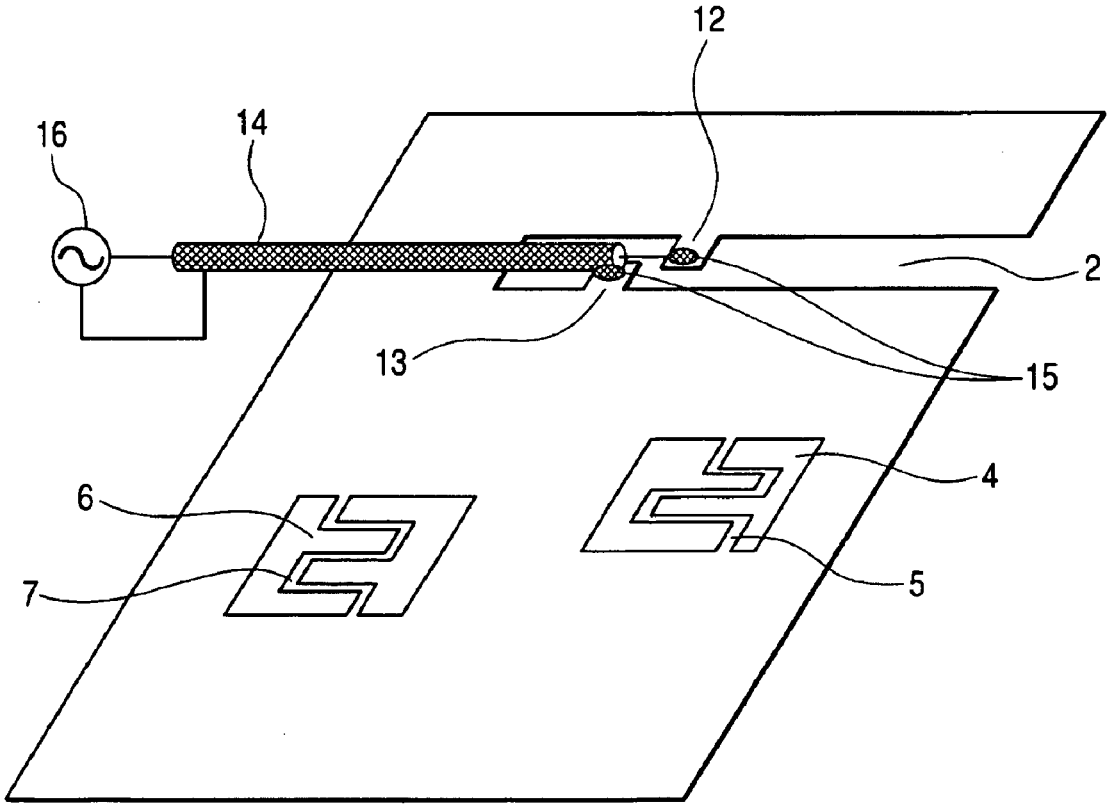
FIG. 8 is a structural drawing for explaining an eighth embodiment of the invention.

An eighth embodiment of the invention will be described with reference to FIG. 8. FIG. 8 is a diagram showing the configuration of a multi-mode plate antenna according to the present invention. The point different from the embodiment of FIG. 1 is that a first tapping conductor 12 and a second tapping conductor 13 are formed in the slit 2 so as not to be in contact with each other, an inner conductor at one end of a coaxial line 14 is electrically connected to the first tapping conductor 12 by a solder 15, an outer conductor is electrically connected to the second tapping conductor 13 by the solder 15, and inner and outer conductors at the other end of the coaxial line 14 are coupled to an exciting level and a ground level at an external exciting point 16.

According to the eighth embodiment, the multi-mode antenna according to the present invention can be coupled to an RF circuit part which is spatially apart. Consequently, there is an effect of facilitating mounting of the multi-mode antenna of the present invention onto a multi-mode wireless apparatus capable of enjoying a plurality of wireless system services.

Figure 9:
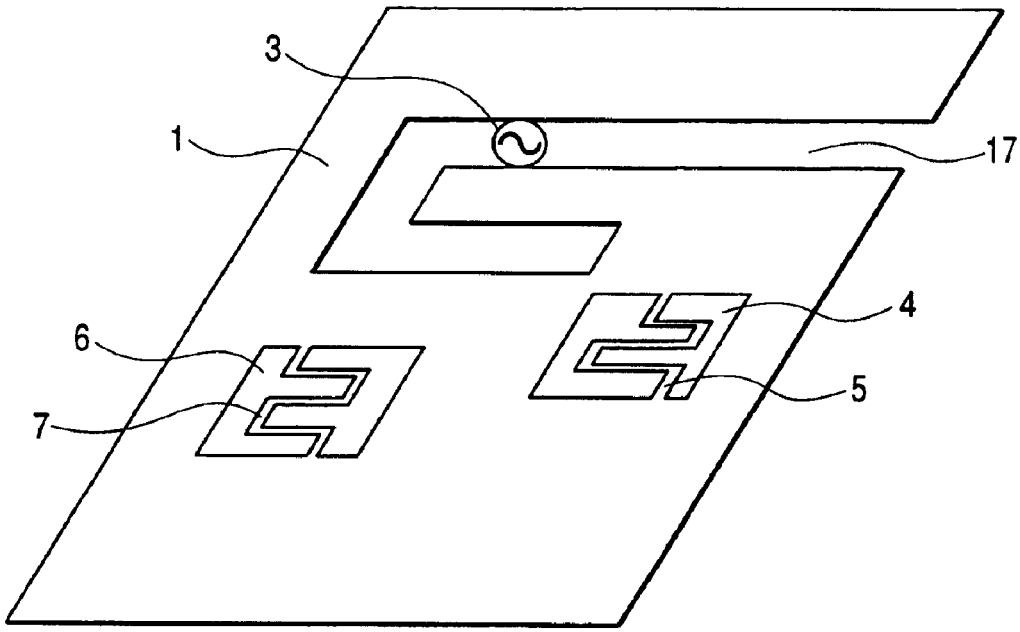
FIG. 9 is a structural drawing for explaining a ninth embodiment of the invention.

A ninth embodiment of the invention will be described with reference to FIG. 9. FIG. 9 is a diagram showing the configuration of a multi-mode plate antenna according to the present invention. The point different from the embodiment of FIG. 1 is that, in place of the slit 2 having the linear shape, a meandering slot 17 having a shape which is folded in the conductive plate 1 is formed.

According to the ninth embodiment, as compared with the embodiment of FIG. 1, the slit can be made longer. Consequently, resonance at a lower frequency can be realized with the same dimensions of the conductive plate. In other words, resonance at the same frequency can be realized with smaller dimensions of the conductive plate, so that the embodiment is effective at reducing the size of the multi-mode antenna according to the present invention.

Figure 10:
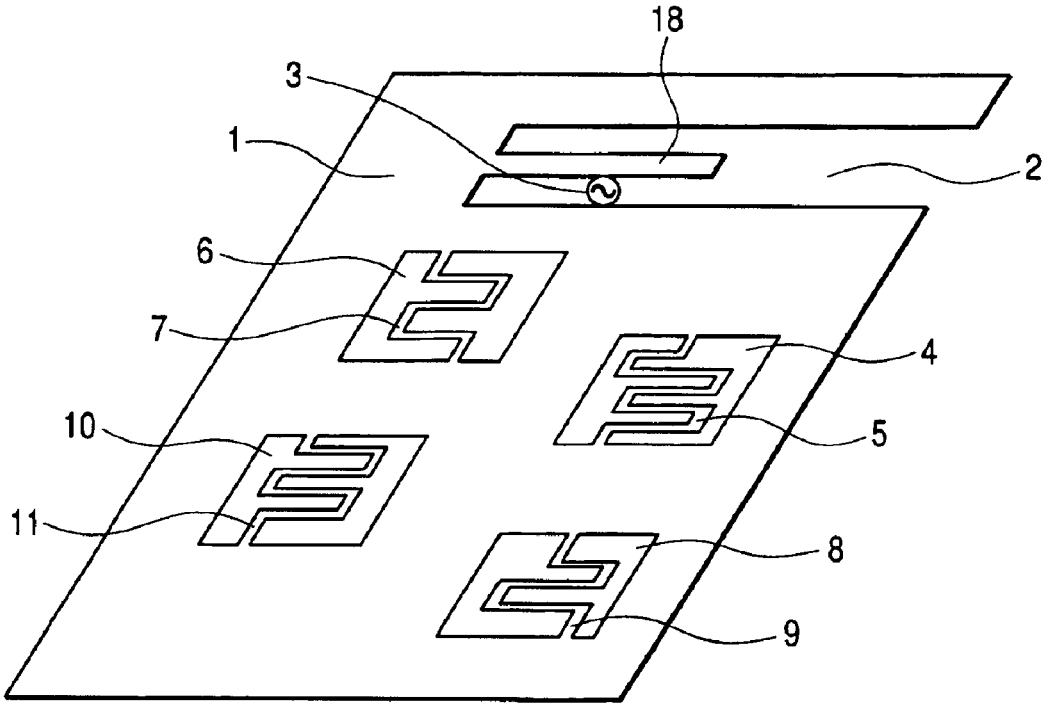
FIG. 10 is a structural drawing for explaining a tenth embodiment of the invention.

A tenth embodiment of the invention will be described with reference to FIG. 10. FIG. 10 is a diagram showing the configuration of a multi-mode plate antenna according to the present invention. The point different from the embodiment of FIG. 2 is that an open ended coplanar conductive strip 18 which is a part extended from the conductor into the slit 2 is formed in the slit 2, and a part of the open ended coplanar conductive strip 18 is coupled to the exciting level of the exciting point 3.

According to the tenth embodiment, two different slits are formed or another slit is formed in a slit when seen from the exciting point 3. Consequently, because of the structure of the plurality of slits, two different resonance phenomena are brought about by the slits themselves. Thus, a larger number of resonance phenomena as compared with the embodiment of FIG. 2 can be realized, and it produces an effect of increasing the number of modes of the multi-mode antenna of the present invention.

Figure 11:
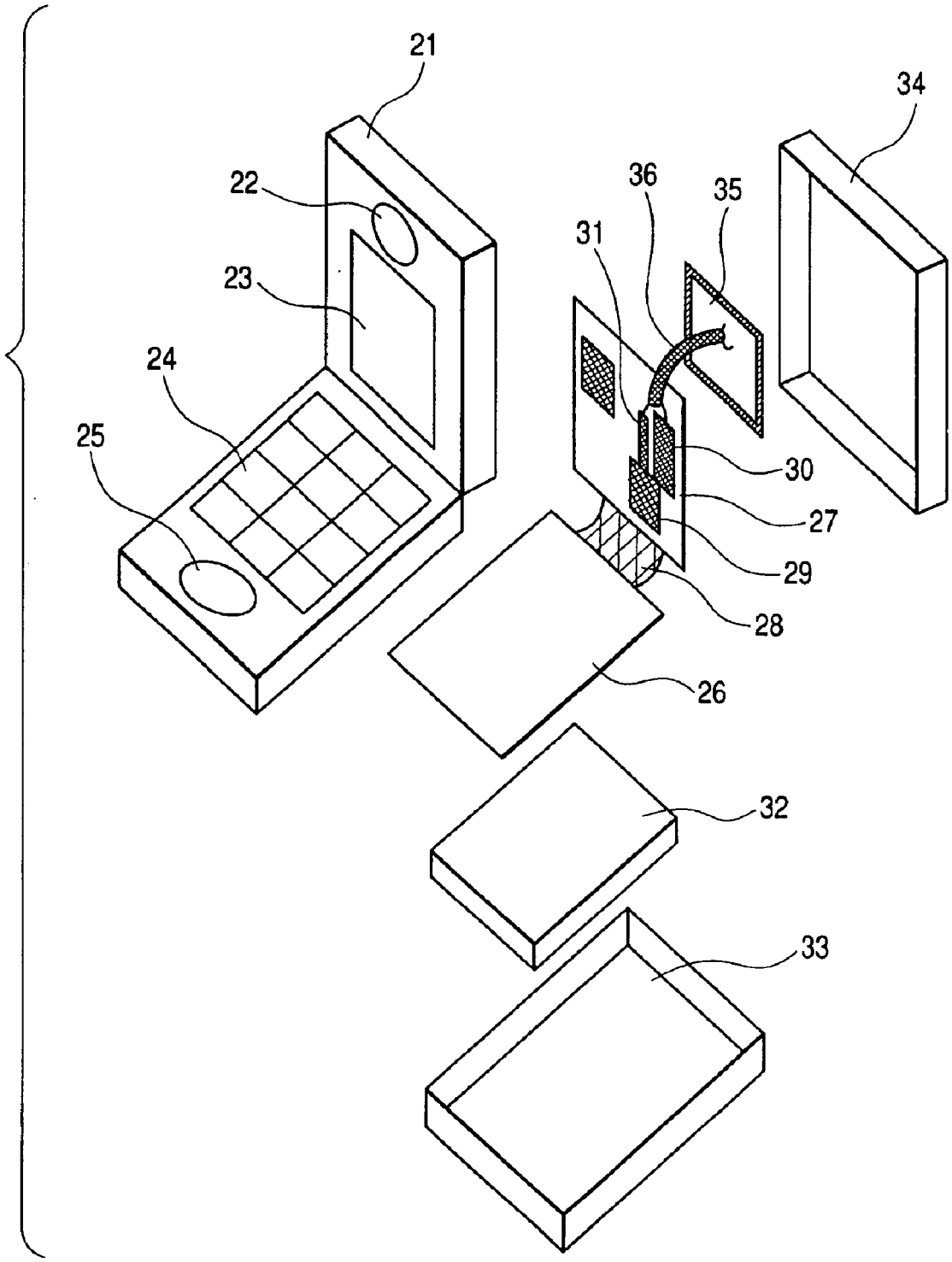
FIG. 11 is a development for explaining an eleventh embodiment of a wireless apparatus on which an antenna of the invention is mounted.

An eleventh embodiment of the invention will be described with reference to FIG. 11. FIG. 11 is a diagram showing an embodiment of a wireless apparatus on which the multi-mode plate antenna of the present invention according to any of the first to tenth embodiments is mounted.

As shown in FIG. 11, on a foldable front chassis 21, a speaker 22, a display 23, a keypad 24, and a microphone 25 are mounted. The front chassis 21 is covered with a first back chassis 33 and a second back chassis 34. On the inside of those chassis, a first circuit board 26 and a second circuit board 27 connected to each other via a flexible cable 28, a multi-mode plate antenna 35 according to the present invention, and a battery 32 are housed.

On the circuit board 27, an RF circuit part 29 is mounted, and a ground conductive pattern 30 coupled to the ground level of the RF circuit part 29 and a signal conductive pattern 31 coupled to the signal input/output point of the RF circuit part 29 are formed. The multi-mode antenna 35 is connected to the RF circuit part 29 via a coaxial cable 36. Specifically, the ground conductive pattern 30 and the ground potential of the exciting point of the multi-mode antenna 35 are connected to each other via an outer conductor of the coaxial cable 36, and the signal conductive pattern 31 and the exciting level of the exciting point of the multi-mode antenna 35 are connected to each other via an inner conductor of the coaxial cable 36.

The structure shown in FIG. 11 is characterized in that the multi-mode plate antenna 35 according to the present invention is positioned on the side opposite to the display 23 or the speaker 22 over the circuit board 27.

According to the eleventh embodiment, the wireless apparatus which enjoys services of a plurality of wireless systems can be realized in a form in which the antenna is built in. Consequently, the embodiment is very effective at reducing the size of the wireless apparatus and improving housing and portability to the user.

Figure 12:
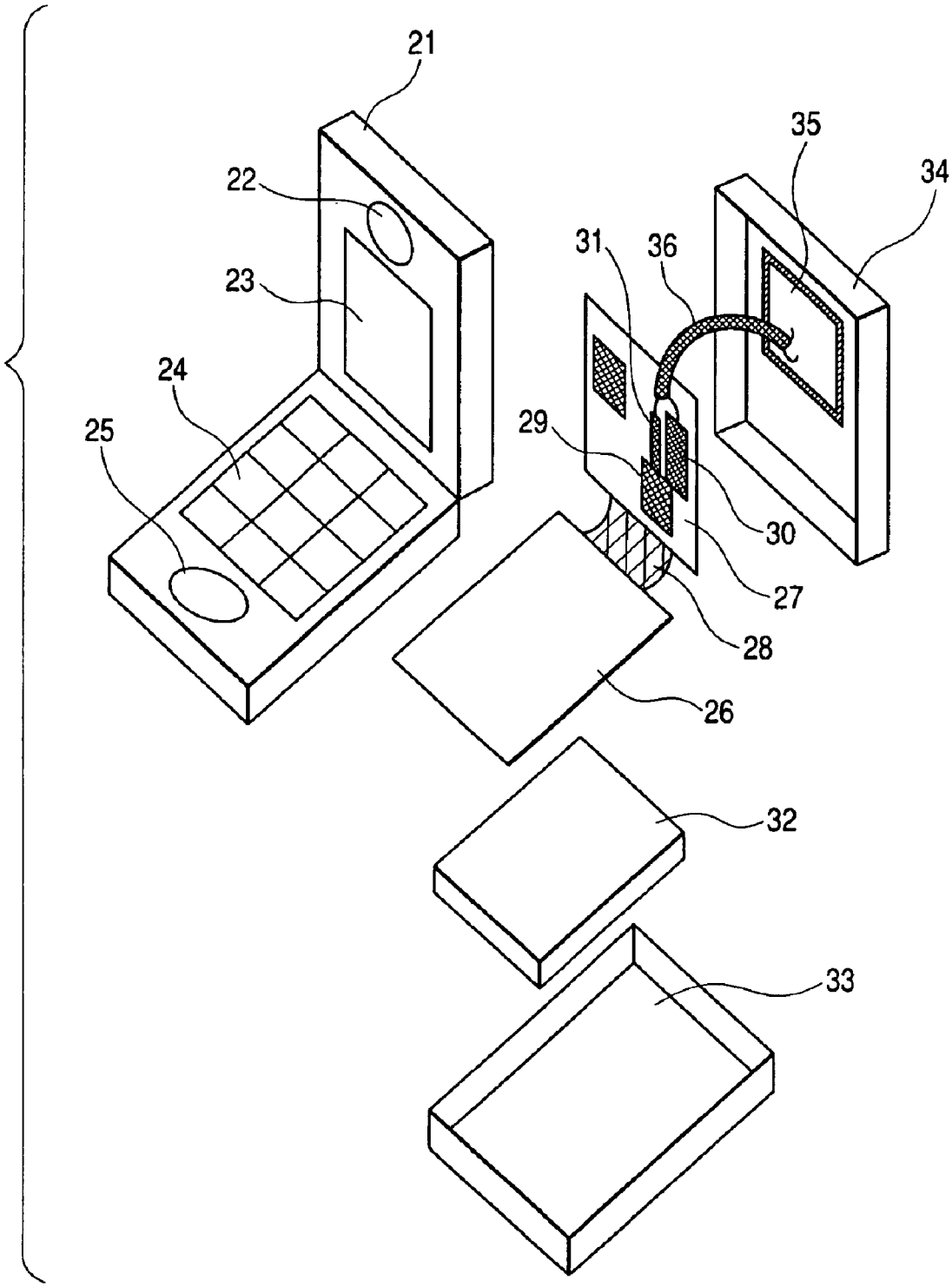
FIG. 12 is a development for explaining a twelfth embodiment of a wireless apparatus on which the antenna of the invention is mounted.

A twelfth embodiment of the invention will be described with reference to FIG. 12. FIG. 12 is a diagram showing another embodiment of a wireless apparatus on which the multi-mode plate antenna of the present invention according to any of the first to tenth embodiments is mounted.

The point different from the embodiment of FIG. 11 is that the multi-mode plate antenna 35 according to the present invention is embedded in the back chassis 34. In the twelfth embodiment, after assembling the chassis, relative positions of the multi-mode antenna 35 and the circuit board 27 are fixed. Consequently, the embodiment is very effective at improving stability of antenna operation against vibrations and impacts during use of the wireless apparatus. The multi-mode plate antenna 35 may be adhered to the inner face of the second back chassis 34.

Figure 13:
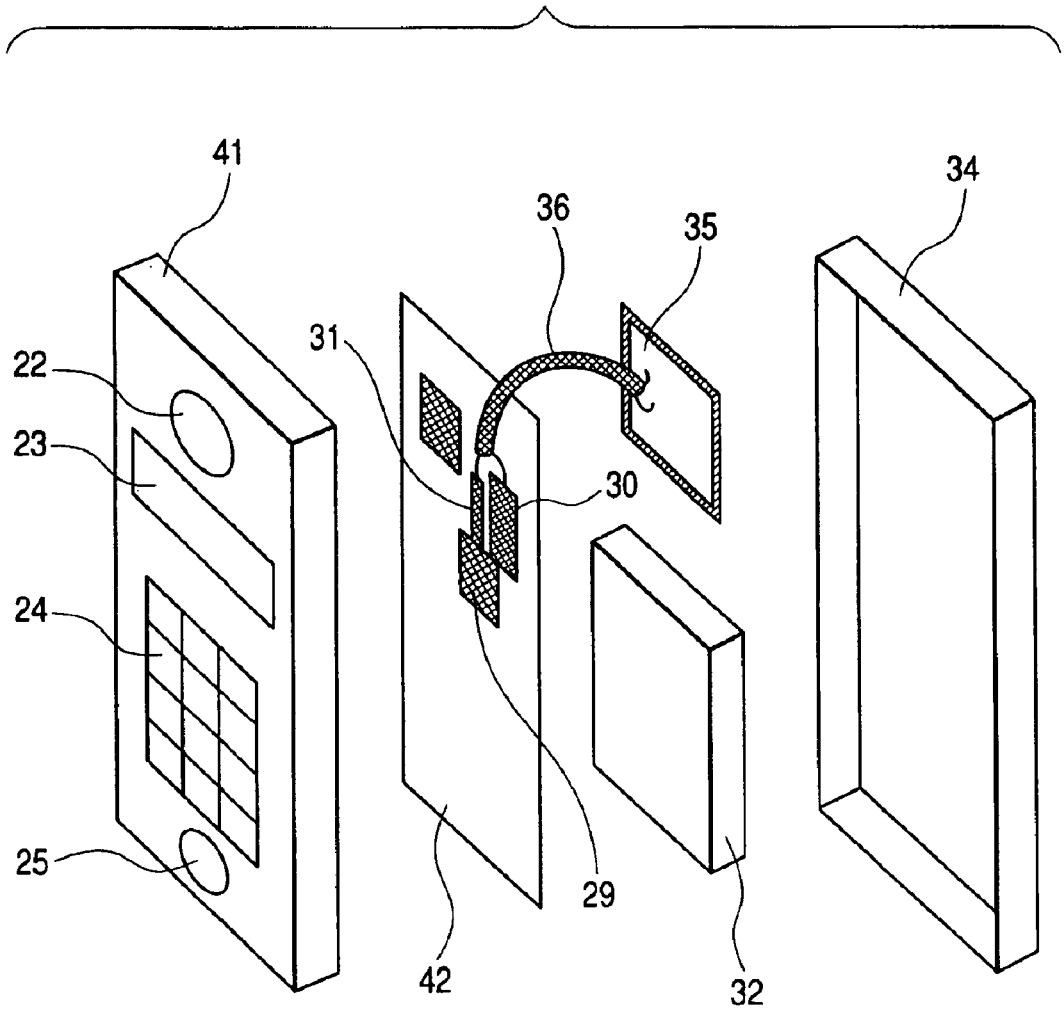
FIG. 13 is a development for explaining a thirteenth embodiment of a wireless apparatus on which the antenna of the invention is mounted.

A thirteenth embodiment of the invention will be described with reference to FIG. 13. FIG. 13 is a diagram showing another embodiment of a wireless apparatus in which the multi-mode plate antenna of the present invention according to any of the first to tenth embodiments is mounted.

As shown in FIG. 13, the speaker 22, display 23, keypad 24, and microphone 25 are mounted on a front chassis 41. The front chassis 41 is covered with the back chassis 34. On the inside of the front and back chassis 41 and 34, a circuit board 42, the multi-mode plate antenna 35 according to the present invention, and the battery 32 are housed.

On the circuit board 42, the RF circuit part 29 is mounted, and the ground conductive pattern 30 coupled to the ground level of the RF circuit part 29 and the signal conductive pattern 31 coupled to the signal input/output point of the RF circuit part 29 are formed. The multi-mode antenna 35 is connected to the RF circuit part 29 via the coaxial cable 36. Specifically, the ground conductive pattern 30 and the ground potential of the exciting point of the multi-mode antenna 35 are connected to each other via an outer conductor of the coaxial cable 36, and the signal conductive pattern 31 and the exciting level of the exciting point of the multi-mode antenna 35 are connected to each other via an inner conductor of the coaxial cable 36.

The structure is characterized in that the multi-mode plate antenna 35 according to the present invention is positioned on the side opposite to the display 23, microphone 25, speaker 22 or keypad 24 over the circuit board 42.

According to the thirteenth embodiment, the wireless apparatus which enjoys services of a plurality of wireless systems can be realized in a form in which the antenna is built in. Consequently, the embodiment is very effective at reducing the size of the wireless apparatus and improving housing and portability to the user. As compared with the embodiment of FIG. 11, since the circuit board and the chassis can be integrally manufactured, the thirteenth embodiment is effective at reducing the volume of the apparatus and reducing the manufacturing cost by a decreased number of assembling processes as compared with the embodiment of FIG. 11.

Figure 14:
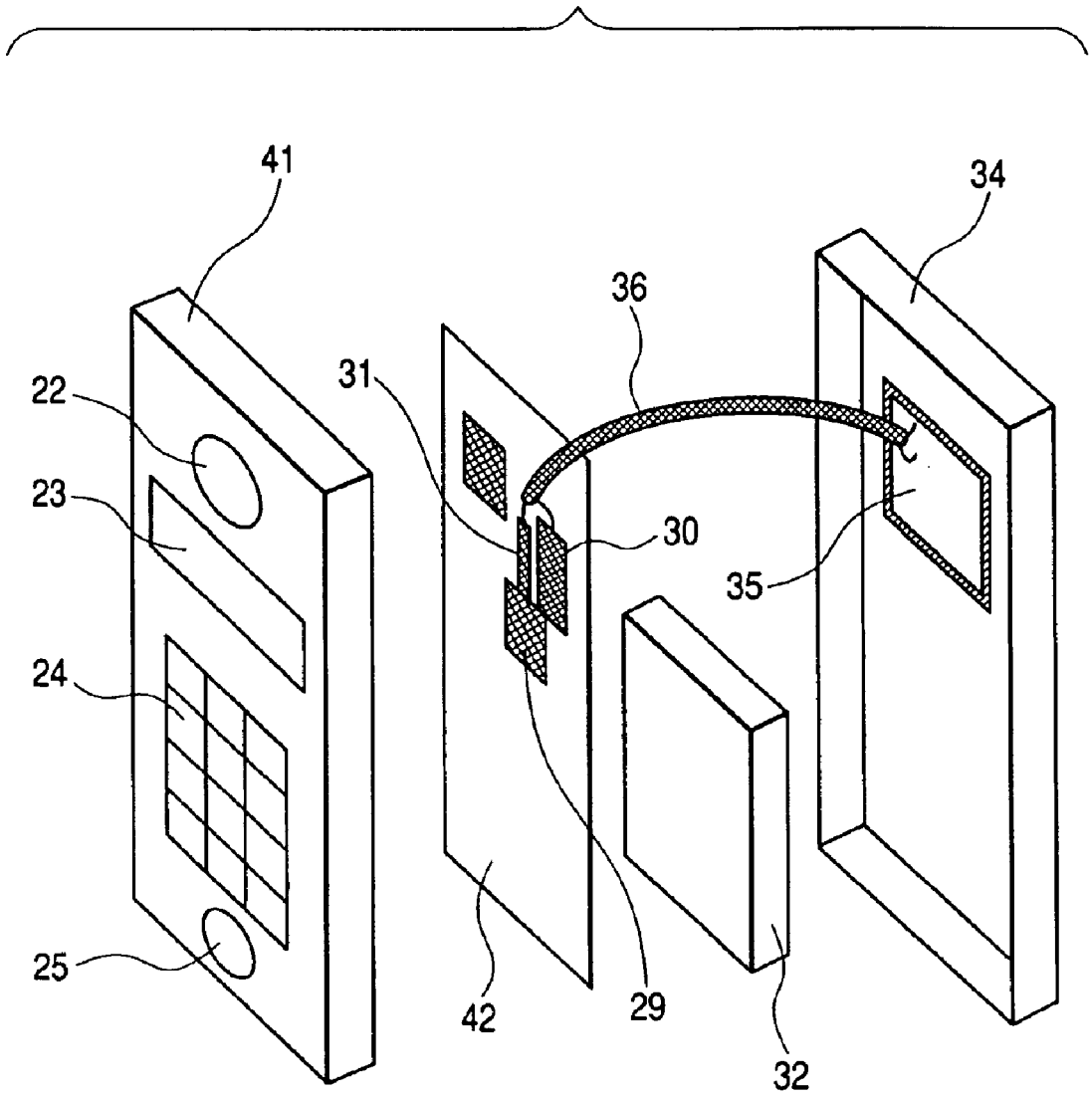
FIG. 14 is a development for explaining a fourteenth embodiment of a wireless apparatus on which the antenna of the invention is mounted.

A fourteenth embodiment of the invention will be described with reference to FIG. 14. FIG. 14 is a diagram showing another embodiment of a wireless apparatus on which the multi-mode plate antenna of the present invention according to any of the first to tenth embodiments is mounted.

The point different from the embodiment of FIG. 13 is that the multi-mode plate antenna 35 according to the present invention is embedded in the back chassis 34. In the fourteenth embodiment, after assembling the chassis, relative positions of the multi-mode antenna 35 and the circuit board 42 are fixed. Consequently, the embodiment is very effective at improving stability of antenna operation against vibrations and impacts during use of the wireless apparatus. The multi-mode plate antenna 35 may be adhered to the inner face of the back chassis 34.

According to the present invention, at a plurality of frequencies, excellent impedance matching between the RF circuit part and the free space is realized with the structure of the conductive plate. Therefore, the present invention produces an effect of realizing the small, low-cost antenna suitable for a multi-media wireless apparatus which provides a plurality of information transmission services to the user by using carrier waves of different frequencies. Since one exciting point is shared by a plurality of frequencies, integration of the RF circuit part to be connected to the antenna is facilitated. Thus, miniaturization of the multi-mode wireless apparatus and reduction in the manufacturing cost can be realized.

It is further understood by those skilled in the art that the foregoing description is a preferred embodiment of the disclosed device and that various changes and modifications may be made in the invention without departing from the spirit and scope thereof.

What is claimed is:

1. An antenna comprising:

a conductive plate in which a slit is formed;

an exciting point provided at the conductive plate around the slit;

at least one enclosed opening formed in the conductive plate and surrounded by the conductive plate; and a conductive strip disposed in the enclosed opening and connecting different two points of the conductive plate around the enclosed opening.

2. The antenna according to claim 1, wherein said antenna is a multi-mode plate antenna.

3. The antenna according to claim 1, wherein a signal level and a ground level of said exciting point are provided at the two points in the conductive plate around the slit, which face each other over said slit.

4. The antenna according to claim 1, wherein the number of said enclosed openings is an even number.

5. The antenna according to claim 1, wherein a direction of a line connecting a start point and an end point of said conductive strip is almost the same as a longitudinal direction of said slit.

6. The antenna according to claim 1, wherein a direction of a line connecting a start point and an end point of said conductive strip and a longitudinal direction of said slit are almost orthogonal to each other.

7. The antenna according to claim 1, wherein said conductive strip has a folded structure.

8. The antenna according to claim 1, wherein said slit has a meandering structure.

9. A wireless apparatus comprising:

a speaker;

a display;

a key pad;

a microphone;

wherein the speaker, the display, the key pad and the microphone are disposed on the surface of a chassis;

a circuit board housed in the chassis; and an antenna connected to an RF circuit mounted on the circuit board, the antenna comprising:

a conductive plate in which a slit is formed;

an exciting point provided at the conductive plate around the slit;

at least one enclosed opening formed in the conductive plate and surrounded by the conductive plate; and a conductive strip disposed in the enclosed opening and connecting two different points in the conductive plate around the enclosed opening, wherein the antenna is housed in said chassis and is disposed on the side opposite to any of said speaker, display, key pad, and microphone over said circuit board.

10. The wireless apparatus according to claim 9, wherein said antenna is connected to said RF circuit via a coaxial cable.

11. The wireless apparatus according to claim 10, wherein said antenna is embedded in said chassis.

* * * * *